United States Patent [19]

Sterling

[11] 4,334,684

[45] Jun. 15, 1982

[54] GOLF PUTTING TRAINING DEVICE

[76] Inventor: Robert H. Sterling, 121 S. Bentley Ave., Los Angeles, Calif. 90049

[21] Appl. No.: 262,025

[22] Filed: May 8, 1981

[51] Int. Cl.[3] ..... A63B 69/36

[52] U.S. Cl. ..... 273/192

[58] Field of Search ..... 273/186 A, 191 R, 192

[56] References Cited

U.S. PATENT DOCUMENTS 2,084,901 6/1937 Eisenberg ..... 273/192

4,133,535 1/1979 Marsh ..... 273/192

*Primary Examiner*—George J. Marlo

*Attorney, Agent, or Firm*—Keith D. Beecher

[57] ABSTRACT

A device for teaching the proper stroke of putting in the game of golf with the attendant muscle memory. The device consists of a stand which may be set on the floor of a den, living room, office, or the like, or on a putting green; and it includes a pair of spaced and parallel bars which are supported up from the surface of the floor or green on either side of the path the ball must take to be putted into the hole. A pair of bushings are respectively supported on the bars to be slidable along the bars, and a bracket is pivotally mounted to the bushings and extends across the device from one of the bushings to the other. A putter may be clamped to the bracket at any desired angle, and when grasped is caused to move through the correct putting stroke. The putter may be used with or without a ball, and it is repeatedly and frequently moved in the device by the person, until the proper putting stroke becomes natural, comfortable, and automatic.

4 Claims, 2 Drawing Figures

GOLF PUTTING TRAINING DEVICE

BACKGROUND

In many respects, the correct use of the putter represents a more difficult problem for golfers than the other clubs. This is due to the relative delicacy and reduced arc of the putting stroke, and the necessity for striking the ball with the face of the putter precisely perpendicular to the intended path of the ball and for maintaining this position of the putter during the entire putting stroke. Accuracy of stroking is more important with the putter than with any other club because of the small target at which the ball is directed, and the absolute requirement that unless the indicated relation of the club face and the ball is established, the ball will be irregularly struck and thereby off the intended line.

Accordingly, the principal objective of the present invention is to provide a putting instruction device in the nature of a mechanical aid which enables the user to develop the feel of the proper stroke during the backswing, impact and follow-through. The putter is mechanically guided by the device during its movement so that the player may concentrate on other factors, such as the extent of the arc and the force at which the ball is to be propelled to the hole.

A further objective of the present invention is to provide a training device whose use enables the player to develop a clear mental picture of the putting stroke, and which may be used with equal facility indoors or outdoors and by right- or left-handed players. A still further objective is to provide such a training device which is inexpensive to manufacture, which can be easily handled, and which can be employed with any putting stance and any type of putter.

In brief, the purpose and intendment of the device of the invention is to heighten muscle memory; this being achieved by repeatedly practicing the correct putting stroke by use of the device, with or without a ball, and not only on the putting green, but in the office and at home.

DETAILED DESCRIPTION OF THE ILLUSTRATED EMBODIMENT

Figure 2:
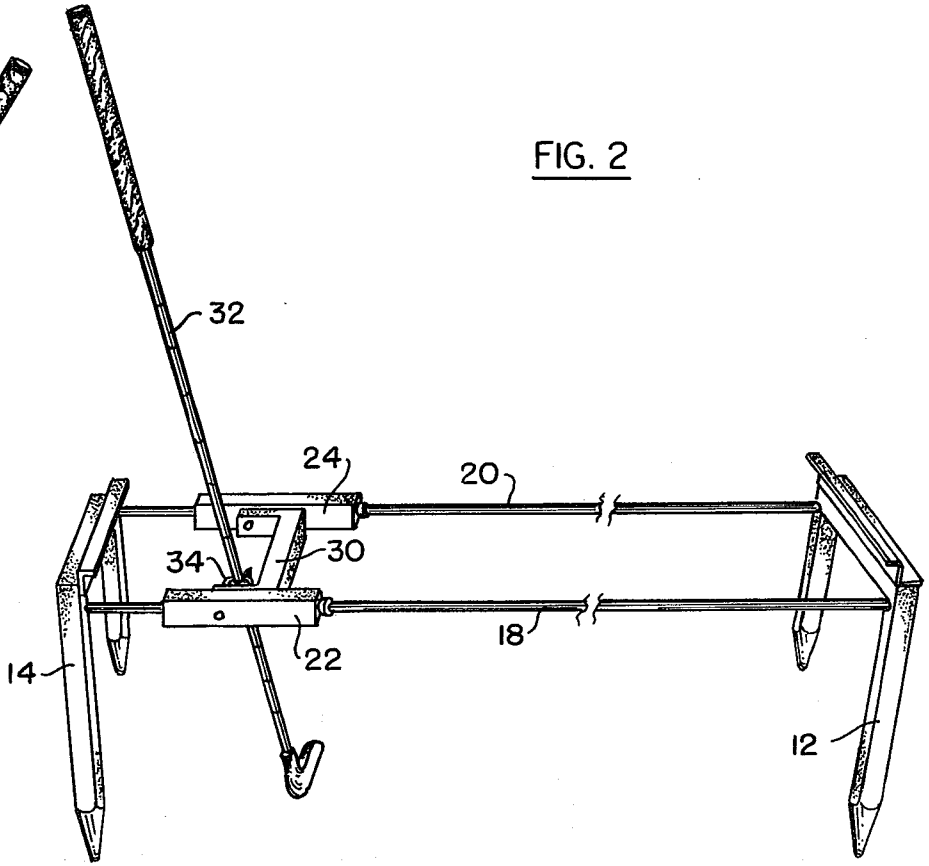
FIG. 2 is a further perspective view of the device taken from a different angle.
Figure 1:
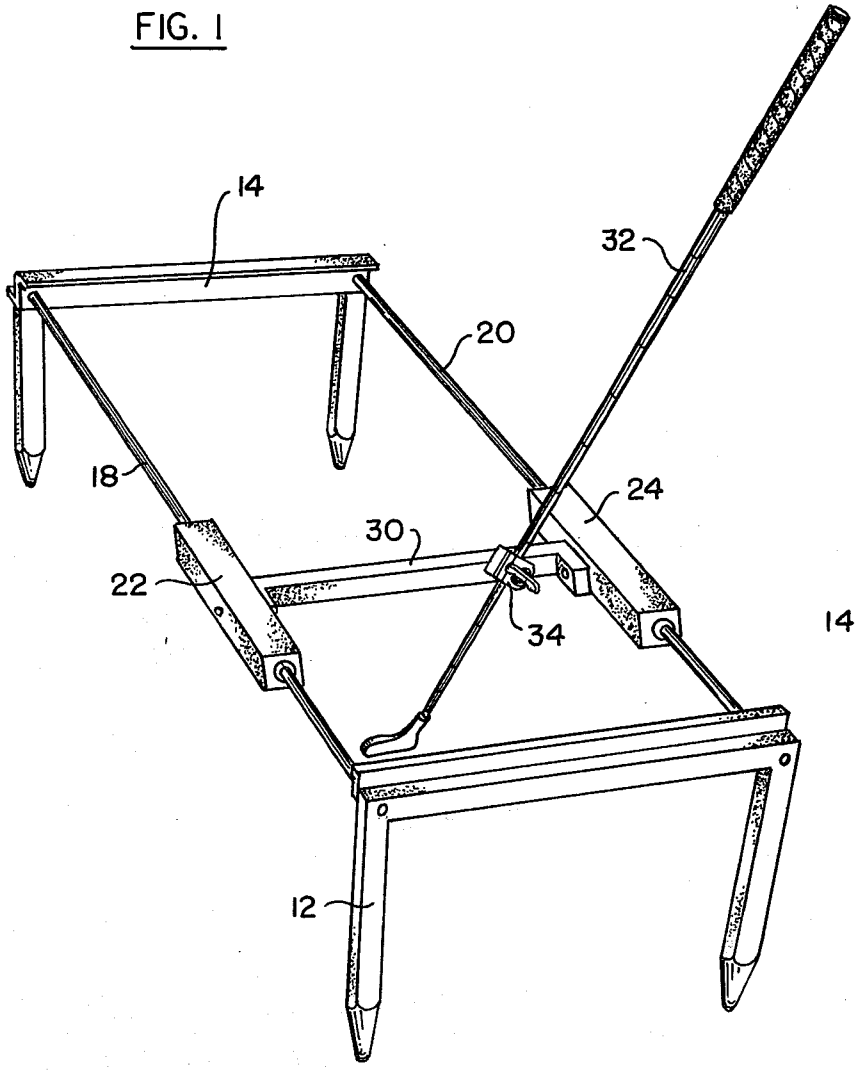
FIG. 1 is a perspective view of a training device constructed in accordance with one embodiment of the invention.

The putting training device of the invention in the illustrated embodiment includes two end brackets 12 and 14 which may be constructed, for example, of polyvinylchloride, or any other appropriate material. The end brackets 12 and 14 each has a U-shaped configuration to provide legs for the device, as shown. Each of the legs may be pointed at its lower end to enable the device to be embedded into the turf, when the device is placed, for example, on a putting green, so as to provide a film and rigid support for the device.

A pair of spaced and parallel side bars 18 and 20 extend from one of the end brackets to the other, and these bars are supported up from the surface of the green by the end brackets. The side bars may be composed, for example, of #303 stainless steel, or any other appropriate material.

A pair of bushings 22 and 24, each of which may be lined with an appropriate lubricating material such as Teflon, are slidably mounted on the bars 18 and 20, for movement along the bars from one end bracket to the other. An arm 30 is pivotally mounted to the bushings 20 and 24 at its opposite ends, and the arm extends between the bushings from one to the other perpendicular to the axes of the side bars 20 and 22. A putter 32 is clamped to the bracket 30 by a clamp 34, and may be set to any desired angle with respect to the surface of the putting green.

In the operation of the device, it is set on the putting green, or any other surface, with the bars 18 and 20 disposed parallel to the path along which the ball is to be putted to the hole, on either side of the path. The putter is then clamped to the arm 30 by means of bracket 34, and is clamped to the arm at any desired putting angle. A ball may then be placed in front of the putter blade, with the putter, for example, midway between the two end brackets 12 and 14. The putter is then moved back away from the ball, and is then moved through the ball to putt the ball toward the hole. The operation of the device is such that as the putter is moved, the arm 30 turns, and the bushings 30 and 34 slide, such that the putter is constrained to the actual putting stroke by which the ball is properly putted into the hole.

As stated above, while using the device of the invention, the golfer can concentrate on putting the ball with the proper force and length of stroke so that the ball will accurately drop in the hole, and can free his mind from other mechanics of the putting stroke. At the same time, continued practice using the device automatically develops muscle memory and conditions the golfer to use the proper putting stroke.

It will be appreciated that although a particular embodiment of the invention has been shown and described, modifications may be made. It is intended in the claims to cover all modifications which come within the true spirit and scope of the invention.

What is claimed is:

1. A putting training device comprising: first and second end brackets for supporting the device on a putting surface; first and second side bars extending in spaced and parallel relationship from one of the end brackets to the other and displaced upwardly by the end brackets from the putting surface; first and second bushings respectively mounted on the side bars and slidable in either direction along the side bars; a transverse arm pivotally coupled at its ends to the bushings and extending between the bushings perpendicular to the axes of the side bars; and a mounting bracket attached to said transverse arm for clamping the shaft of a putter to the transverse arm with the blade of the putter adjacent to the putting surface.

2. The putting training device defined in claim 1, in which said mounting bracket is adjustable to clamp the shaft of the putter to the transverse arm at any selected angle.

3. The putting training device defined in claim 1, in which said end brackets define supporting legs for the device adjacent the ends of the side bars.

4. The putting training device defined in claim 3, in which said legs have lower ends configured to be received into the putting surface.

* * * * *